US005698949A

United States Patent [19]

Lien et al.

[11] Patent Number: 5,698,949

[45] Date of Patent: Dec. 16, 1997

[54] HOLLOW BEAM ELECTRON TUBE HAVING $TM_{0x0}$ RESONATORS, WHERE X IS GREATER THAN 1

[75] Inventors: Erling L. Lien, Los Altos; Heinz Bohlen, Mountain View, both of Calif.

[73] Assignee: Communications & Power Industries, Inc., Palo Alto, Calif.

[21] Appl. No.: 413,034

[22] Filed: Mar. 28, 1995

[51] Int. Cl.[6] ..... H01J 23/07; H01J 25/14

[52] U.S. Cl. ..... 135/5.31; 315/5.37; 315/5.39; 330/45; 333/227

[58] Field of Search ..... 315/5.31, 5.37, 315/5.39; 333/227; 330/45; 331/81, 83

[56] References Cited

U.S. PATENT DOCUMENTS

| | | | |
|---|---|---|---|
| 2,407,274 | 9/1946 | Hartley et al. | 331/81 X |
| 2,409,224 | 10/1946 | Samuel | 331/81 X |
| 2,634,383 | 4/1953 | Gurewitsch | 315/5.31 |
| 3,376,524 | 4/1968 | Wang | 333/227 |
| 3,392,300 | 7/1968 | Arnaud et al. | 315/5.37 X |
| 3,725,751 | 4/1973 | Levin | 315/5.43 |
| 4,100,457 | 7/1978 | Edgcombe | 315/5.51 |
| 4,210,845 | 7/1980 | Lebacqz | 315/5.25 |
| 4,286,192 | 8/1981 | Tanabe et al. | 315/5.41 |
| 4,300,105 | 11/1981 | Busacca et al. | 315/5.44 X |
| 4,480,210 | 10/1984 | Preist et al. | 315/4 |
| 4,508,992 | 4/1985 | Bohlen et al. | 315/5.39 |
| 4,527,091 | 7/1985 | Preist | 315/5 |
| 4,611,149 | 9/1986 | Nelson | 315/5.39 |
| 4,629,938 | 12/1986 | Whitham | 315/5.41 |
| 5,132,638 | 7/1992 | Friedman et al. | 315/5.31 X |
| 5,233,269 | 8/1993 | Lien | 315/5.37 |
| 5,235,249 | 8/1993 | Mourier | 315/5.39 X |
| 5,239,235 | 8/1993 | Mourien | 315/5.39 X |
| 5,315,210 | 5/1994 | Lien | 315/5.39 |
| 5,317,233 | 5/1994 | Lien et al. | 315/5.39 X |

FOREIGN PATENT DOCUMENTS

| | | | |
|---|---|---|---|
| 1697559 A1 | 12/1993 | Russian Federation . | |
| 784609 A1 | 2/1994 | Russian Federation . | |
| 1136666 A1 | 3/1994 | Russian Federation . | |
| 1738019 A1 | 3/1994 | Russian Federation . | |
| 1333133 | 5/1991 | U.S.S.R. | 315/5.39 |
| 1333133 A | 5/1991 | U.S.S.R. . | |

*Primary Examiner*—Benny T. Lee

*Attorney, Agent, or Firm*—Lowe, Price, LeBlanc & Becker

[57] ABSTRACT

An inductive output tube, e.g., a KLYSTRODE, or a klystron, has a substantially hollow electron beam traversing a resonant cavity excited to the $TM_{0x0}$ mode, where x is greater than 1.

38 Claims, 10 Drawing Sheets

HOLLOW BEAM ELECTRON TUBE HAVING $TM_{0x0}$ RESONATORS, WHERE X IS GREATER THAN 1

FIELD OF INVENTION

The present invention relates generally to hollow beam electron tubes having resonators and, more particularly, to such tubes wherein the resonators are excited in the $TM_{0x0}$ mode, where x is greater than 1.

BACKGROUND ART

Inductive output tubes (for example, KLYSTRODES) and klystrons employing hollow electron beams are known. However, many prior tubes of this type have certain problems when used for very high power applications, such as exciting linear accelerators.

Lien, U.S. Pat. No. 5,233,269, particularly FIG. 12, thereof commonly assigned with the present invention, discloses a high-frequency amplifier tube of the KLYSTRODE type wherein a hollow electron beam emitted by a cathode passes through a pyrolytic graphite grid spaced from the cathode by a distance no greater than the distance that an electron emitted from the cathode traverses in a quarter cycle of an RF signal being amplified. The grid high frequency voltage causes the hollow electron beam to be current modulated in response to an input signal to be amplified. The hollow electron beam traverses intermediate and output resonant cavities, and from there is incident on a collector. The intermediate cavity velocity modulates the beam in response to the signal to be amplified. To this end, the intermediate cavity is inductively coupled with the electron beam and is driven by the signal to be amplified by a coupling loop on an exterior wall of the cavity. The grid-cathode resonator responds to a feed-back signal. The output cavity includes a coupling loop on one of its walls, to supply a load with an amplified replica of the input signal. The coupling loops for the intermediate and output cavities are connected to coaxial cables via RF dielectric windows which assist in maintaining a vacuum within the tube.

A problem with the structure disclosed in the '269 patent is that the cross-sectional area of the beam is relatively small because interaction gaps between the electron beam and the resonant cavities are located adjacent a center region of the cavity resonators. This causes the resonators to operate in the $TM_{010}$ mode for the frequencies of the input signal. The electric field of a resonant cavity excited to the $TM_{010}$ mode is basically configured as a cosine wave, such that the peak value of the cosine wave occurs in the center of the resonant cavity and minimum, zero electric fields are on the peripheral walls of the cavity. There are no intermediate electric field nulls in the $TM_{010}$ mode. In the 269 patent, as well as the prior art described therein, i.e., U.S. Pat. Nos. 4,480,210, 4,527,091 and 4,611,149, commonly assigned with the present invention, cylindrical electron beams also traverse cavities operating in the $TM_{010}$ mode.

Prior art klystrons with cylindrical and hollow electron beams include resonant cavities excited in the $TM_{010}$ mode, as well as other modes, such as the $TM_{01x}$ mode, where x is an integer greater than 0; see Lien, U.S. Pat. 5,315,210, commonly assigned with the present invention.

In general, these prior art tubes have been limited by relatively small cross-sectional area electron beams. The small area electron beams require high accelerating voltages to obtain the desired power gain. The use of high voltages results in many problems concerned, for example, with breakdown.

Soviet Union Patents 1,738,019 A1, 1,136,666 A1, 784, 609 A1 and 1,697,559 A1 disclose klystrons having multiple beamlets, each propagating through a separate electron beam tunnel coupled with multiple resonant cavities. The resonant cavities operate in the $TM_{010}$ mode. The beamlets are relatively close to the centers of the cavities, so that the combined area of the beamlets is relatively low. Hence, the same problems, relating to total combined cross-sectional area of the electron beams and high voltage, exist in these Soviet Union patents as in the previously discussed United States patents.

U.S. Pat. No. 4,508,992 discloses a vacuum tube having a rotating electron beam that traverses a longitudinal path through a pair of ring resonators. As time progresses, the electron beam is emitted from different regions of the circular cathode, to provide the rotating effect. The beam is rotated by supplying a travelling wave field to different regions of an electric field structure in proximity to the cathode. The electric field produces an accelerating force that is less than the force necessary to accelerate electrons from the cathode, except at the locations of the electric field structure where the electron beam is emitted at any particular time instant. A perceived problem with this prior art structure is that the travelling wave is not likely to remain in a rotating state. If there is a mismatch in the electric field structure, a reflection is produced. The reflection interacts with the rotating field, causing the rotating field to assume a standing wave, non-rotating pattern. When the standing wave pattern is established, the electron beam emission regions no longer rotate and the electrons are emitted with the desired current density only from a region of the cathode where the electric field is close to maximum accelerating value. Hence, this prior art device is not practical and, to our knowledge, has not actually been reduced to practice.

OBJECTS OF THE INVENTION

It is, accordingly, an object of the present invention to provide a new and improved high power RF amplifier tube.

Another object of the invention is to provide a new and improved high power klystron amplifier tube having a relatively large hollow cross-sectional area electron beam, to reduce the high voltage requirements .of the klystron.

An additional object of the invention is to provide a new and improved high power inductive output tube (e.g., a KLYSTRODE) having appreciable gain, a relatively large hollow cross-sectional area electron beam and relatively low high voltage requirements.

An added object of the present invention is to provide a new and improved cavity resonator having a hollow electron beam tunnel with a relatively large cross-sectional area, which enables a vacuum tube including the resonator to be operated at relatively low voltage.

A further object of the invention is to provide a new and improved RF amplifying tube having a relatively large cross-sectional area hollow electron beam that interacts with a resonant cavity configured so that an RF vacuum window in the cavity has minimum electric field applied to it, even though the window is not located on the cavity wall.

Yet another object of the invention is to provide a new and improved high power RF amplifying tube having coaxial input and output structures concentric with a longitudinal axis of the tube.

Still another object of the invention is to provide a new and improved RF amplifying tube capable of supplying a load, such as a linear accelerator, with megawatts of power.

SUMMARY OF THE INVENTION

In accordance with one aspect of the invention, these and other objects are provided by an electron tube for handling a signal having a frequency in a predetermined frequency band which comprises means for deriving and collecting a substantially hollow linear electron beam traversing a predetermined beam tunnel, and resonant cavity means having an interaction region for varying the beam in the beam tunnel as a function of the signal, wherein the resonant cavity means is configured so electromagnetic fields therein are in the $TM_{0x0}$ mode for frequencies in the band, where x is an integer greater than 1.

The electron tube is preferably configured as a klystron or an inductive output tube; in the latter case, the grid in the cathode-grid structure of the input resonant cavity is biased so the electron beam is modulated to operate in Class A, Class B or Class C.

Preferably, the cavity means includes an input cavity and an output cavity, both configured so electromagnetic fields therein are in the $TM_{0x0}$ mode for frequencies in the band. In the klystron embodiment, the cavity means can include one or more $TM_{0x0}$ mode intermediate cavities between the input and output cavities.

In the preferred embodiments, the beam extends longitudinally and the cavity means includes an output cavity extending radially inward from the interaction region and the beam. An output structure coupled with the .output cavity extends longitudinally in the same direction as the beam tunnel longitudinal axis and is located in the hollow portion of the beam.

In accordance with an additional aspect of the invention, a resonant cavity comprises a hollow electron beam tunnel and a resonant cavity structure having an interaction region with the tunnel, wherein the structure surrounds and is surrounded by the tunnel and is configured to be excited to the $TM_{0x0}$ mode for an electron beam traversing the tunnel, where x is an integer greater than 1.

In accordance with a further aspect of the invention, a resonant cavity comprises a hollow electron beam tunnel and a resonant cavity structure having an interaction region with the tunnel, wherein the structure surrounds and is surrounded by the tunnel and is configured so there is a location removed from metal walls of the cavity where the electric fields have approximately zero magnitude. An RF dielectric vacuum window is at the location.

Another aspect of the invention relates to an electron tube for handling an RF signal having a predetermined frequency .range. The tube has a longitudinal axis and comprises an input coaxial feed responsive to the signal and concentric with the axis and a coaxial output feed concentric with the axis. The feeds extend in the direction of the axis and are centrally located relative to the axis. A cathode concentric with the axis emits an electron beam that traverses an electron beam tunnel concentric with the axis. A first resonant cavity structure is excited by the input signal to modulate the beam. The first resonant cavity structure is (a) arranged so the electron beam propagates in it, (b) concentric with the axis and (c) coupled with the input coaxial feed via a region that extends radially from the axis. A second resonant cavity structure is excited by the modulated beam to drive the output coaxial feed. The second resonant cavity structure is (a) arranged so the electron beam propagates in it, (b) concentric with the axis and (c) coupled with the output coaxial feed via a region that extends radially toward the axis.

In the another aspect, the electron beam is preferably hollow and the electron beam tunnel has a ring-like shape with an inner diameter greater than outer diameters of the input and output coaxial feeds and the first and second resonant cavities are excited to the $TM_{0x0}$ mode for frequencies of the range, where x is an integer greater than 1.

A further aspect of the invention, particularly useful for relatively low frequency input signals, e.g., less than 500 MHz, is that resonators are excited to the $TM_{020}$ mode, and each of the resonators includes an axially extending coaxial resonator having an axial length equal approximately to a quarter wavelength of frequencies in the range.

The above and still further objects, features and advantages of the present invention will become apparent upon consideration of the following detailed descriptions of specific embodiments thereof, especially when taken in conjunction with the accompanying drawings.

DESCRIPTION OF THE PREFERRED EMBODIMENTS

Figure 1:
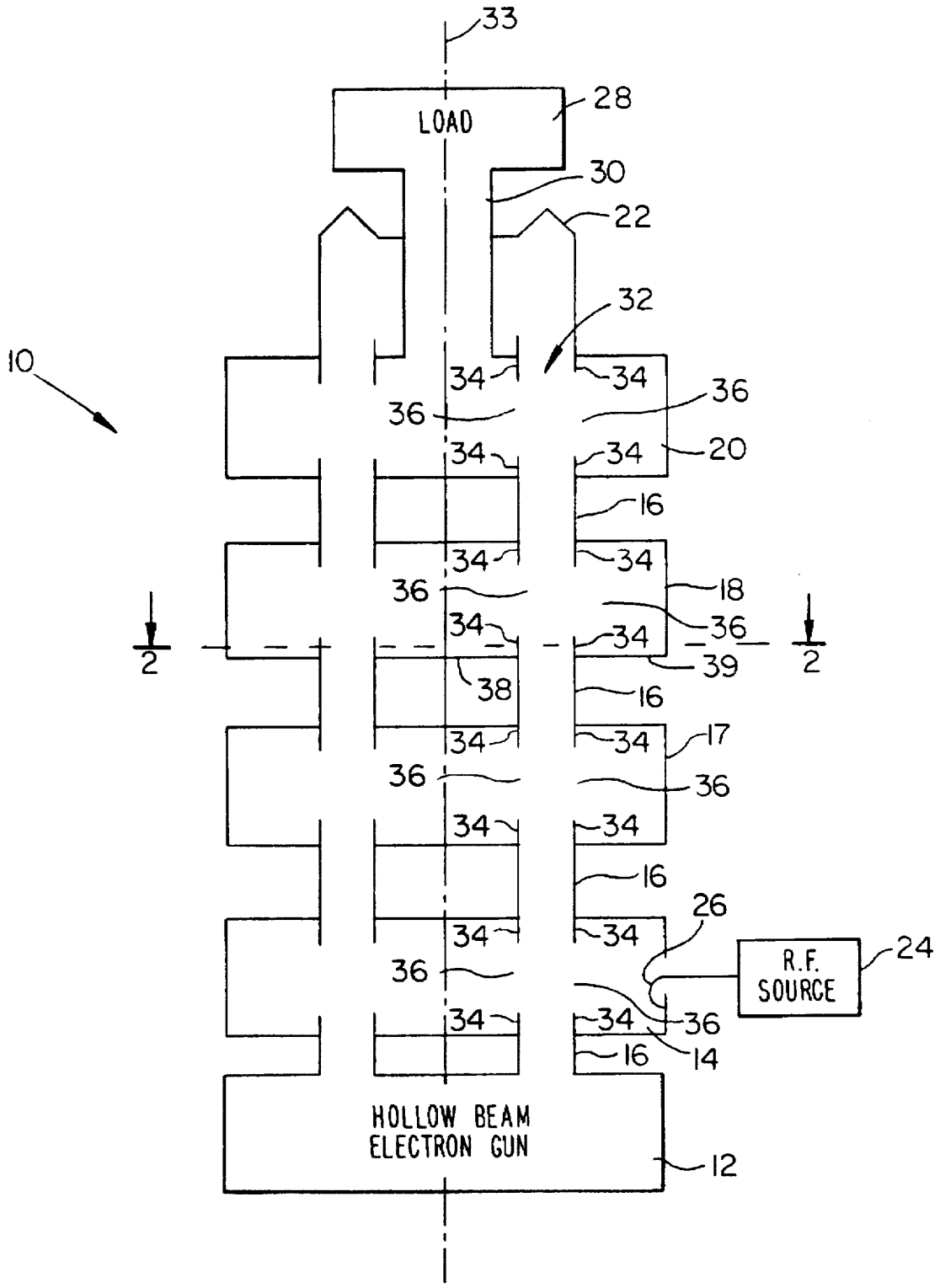
FIG. 1 is schematic, line drawing of a klystron configured in accordance with a preferred embodiment of the invention.

Reference is now made to FIG. 1 of the drawing, wherein klystron tube 10 is illustrated as including hollow beam electron gun 12, input resonant pill box cavity 14 (having surfaces that function as an anode), drift regions 16, intermediate resonant pill box cavities 17 and 18 and output resonant pill box cavity 20, as well as collector 22. Gun 12 produces a relatively low voltage, hollow cylindrical electron beam that is accelerated to and collected by collector 22. The electron beam passes through and is coupled to resonant input cavity 14, where it is velocity modulated at the frequency of RF input signal source 24, coupled via an input feed including loop 26 to cavity 14. The signal of RF source 24 has a predetermined frequency band and is power amplified by tube 10 by approximately 50 db.

The hollow beam emitted by gun 12 is velocity modulated in cavity 14 to a frequency that is determined by the variations of source 24, to produce an oscillating electron beam. The oscillating electron beam traverses drift regions 16, as well as intermediate resonant cavities 17 and 18 and induces an electric field in output resonant cavity 20. Electric fields are also induced in intermediate cavities 17 and 18. The amplitude of the field increases progressively in the intermediate and output resonant cavities downstream of gun 12, becoming largest in output resonator 20. The electric field induced in cavity 20 is coupled to load 28 by wave guide 30. The entire structure of klystron tube 10 and wave guide 30 (except for the input feed and the waveguide, not shown, connecting waveguide 30 to load 28) is symmetrical about tube axis 33, which is coincident with the axis of the cylindrical hollow electron beam derived from gun 12. The drift regions 16 and the regions of cavities 14, 17, 18 and 20 through which the hollow beam from gun 12 passes are commonly referred to as electron beam tunnel 32. The beam also passes through interaction gaps of the resonators.

The hollow beam derived from electron gun 12 has a relatively large area, a feature made possible by the fact that resonators 14, 17, 18 and 20 are excited to the $TM_{0x0}$ mode for the frequencies in the band of source 24, where x is an integer greater than 1. In the specifically described embodiments, cavities 14, 17, 18 and 20 are operated in one of the $TM_{020}$, $TM_{030}$ or $TM_{040}$ modes, but it is to be understood that x can have other values greater than 4. Resonant cavities 14, 17, 18 and 20, as illustrated in FIG. 1, operate in the $TM_{020}$ mode as a result of the dimensions thereof relative to the wave lengths of the frequencies derived by source 24 and because of the placement in these resonators of ridges 34, which define the boundaries of tunnel 32. Beam tunnel 32 is thus shaped as a ridged slot located in the region of off axis electric field peaks in each of the resonators. The region in each of resonators 14, 17, 18 and 20 between the edges of ridges 34 defines interaction gaps 36 between the electron beams and the electromagnetic fields excited in the resonators.

Figure 2:
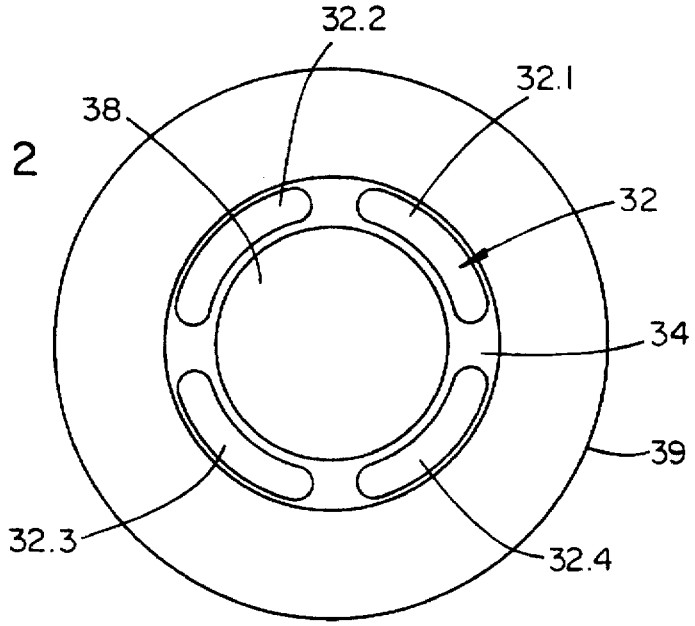
FIG. 2 is a top view, taken through the lines 2—2, of a resonant cavity structure compatible with the tubes illustrated in FIGS. 1, 3, 16 and 17.

The cross-sectional area of beam tunnel 32 (illustrated in FIG. 2) of the $TM_{020}$ resonators 14, 17, 18 and 20 illustrated in FIG. 1 is 15 times the area of the cylindrical beam tunnel of klystrons excited to the $TM_{010}$ mode. As illustrated in FIG. 2, 20 percent of the beam tunnel area comprises ridges 34 that connect inner core 38 and exterior ring portion 39 of the resonators. For a beam filling factor of 0.6, the cross-sectional area of the electron beam for the $TM_{020}$ resonator is 25 times the area of the electron beam for a prior art $TM_{010}$ resonator.

The hollow beam has an approximately annular cross-section with substantially constant inner and outer diameters. The hollow beam is approximately annular in cross-section since it actually has four beam tunnel segments 32.1, 32.2, 32.3 and 32.4, each traversing an angle of about 80°. The beam is not completely annular because of the necessity for solid ridge 34 to have a web-like structure to connect core 38 and exterior portion 39.

The computed value of resistance over quality factor, i.e., R/Q, at the center plane of interaction gaps 36 as seen in FIG. 1, is 4.8 ohms. The low value of R/Q is compensated by the large beam current which is achieved by the large cross-sectional area of the beam, as well as by the low beam impedance that can be used in a klystron.

In one preferred embodiment, the width of beam tunnel 32 in each of resonators 14, 17, 18 and 20 is 1.5 inches, i.e., the distance between the inner and outer radii of beam tunnel 32 between ridges 34 is 1.5 inches. In this embodiment, interaction gap 36 has a slightly larger coupling coefficient than a 2.39 inch diameter conventional cylindrical beam tunnel, which has a normalized tunnel radius of 0.7 radians for a beam voltage of 100 kilovolts.

The structure of FIG. 1 is typically operated such that a DC voltage on the order of −100 kilovolts is applied to electron gun 12. Resonators 14, 17, 18 and 20, as well as collector 22, are operated at approximately DC ground. Suitable electrical insulators (not shown), as employed in the prior art, are provided. The electron beam of the structure of FIG. 1 operates in a continuous mode or pulsed mode, to provide power amplification of the signal from source 24, as coupled to load 28.

Figure 3:
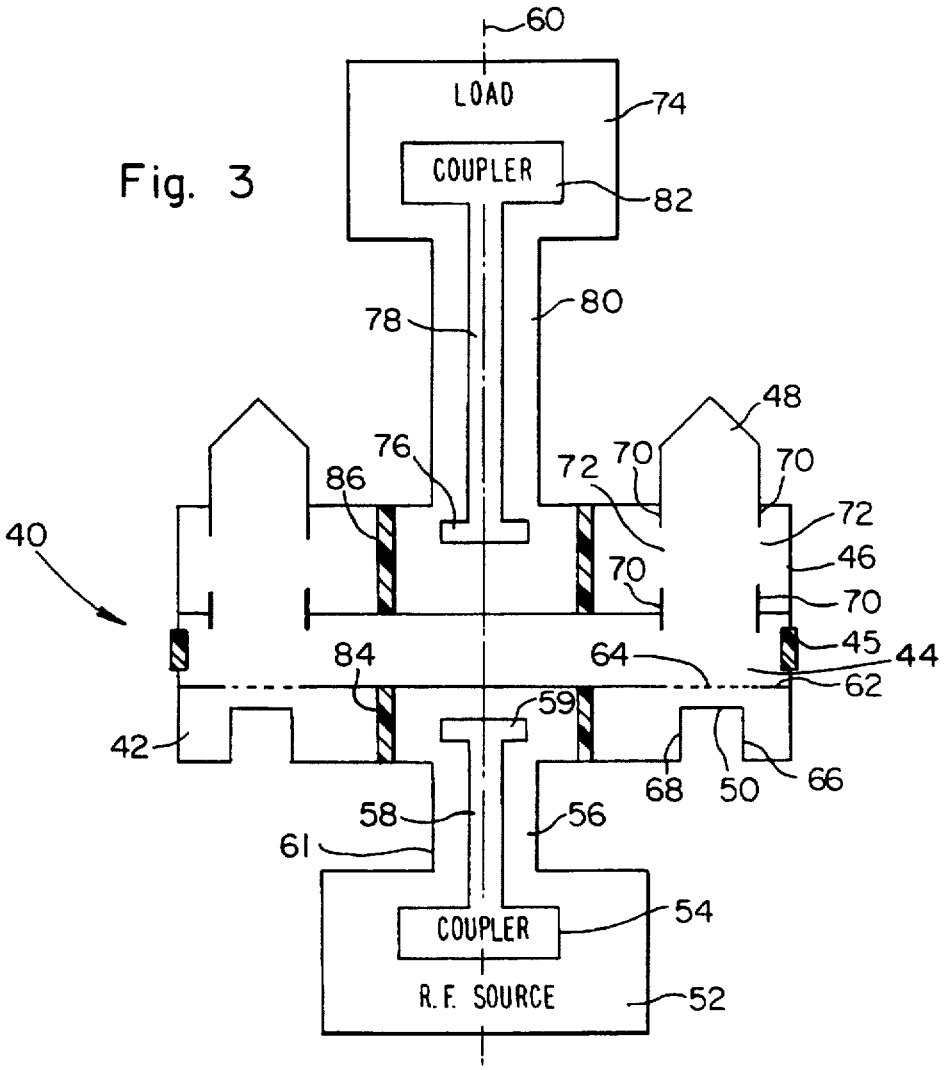
FIG. 3 is a schematic, line drawing of an inductive output tube, for example, a KLYSTRODE, in accordance with a preferred embodiment of the invention.

Reference is now made to FIG. 3 of the drawing, a schematic view of inductive output tube 40 incorporating the principles of the present invention. Inductive output tube 40 is capable of producing power gains of approximately 20 db, but operates more efficiently than the klystron of FIG. 1 because the tube of FIG. 3 can be operated in class B or class C. The structure of FIG. 3 also can be coaxially coupled, via longitudinally extending coaxial structures concentric with the tube axis, with an input source and a load, with the inherent advantages associated with such coupling.

To these ends, inductive output tube 40, illustrated in FIG. 3, includes input resonant pill box cavity 42, electron accelerating region 44, insulator ring 45, output resonant pill box cavity 46 and collector 48. Input resonant cavity 42 includes annular cathode 50 and grid 64 for deriving a hollow, approximately annular cylindrical electron beam that is accelerated in the region between resonator 42 and resonator 46 (having an axial wall 70) and collected by collector 48. The electron beam is current density modulated in input cavity 42 in response to electromagnetic fields produced in the cavity in response to excitation of the cavity by electromagnetic waves resulting from RF input signal source 52. To these ends, RF source 52 includes RF coupler 54 that supplies RF energy to cavity 42 by coaxial feed 56, including center conductor 58 that extends along longitudinal tube axis 60 of tube 40 and terminates at probe 59, as well as outer metal tube 61 that is concentric with axis 60. All of tube 40 and its associated structure are symmetrical about the tube longitudinal axis 60.

Top wall 62 of resonant input cavity 42 includes an annular opening in which is located pyrolytic graphite grid 64. Grid 64 is spaced from cathode 50 by less than the distance that an electron emitted from the cathode can travel in a quarter cycle of the highest frequency derived from source 52. Preferably, grid 64 is made of pyrolytic graphite so it is a non-electron emissive structure. Cathode 50 is biased by a DC source (not shown) so electrons are emitted from cathode 50 during no more than one-half cycle of the electromagnetic energy excited by source 52 in cavity 42 to provide Class B or C operation of tube 40. Resonant cavity 42 includes side walls 66 and 68 on which cathode 50 is supported and which form ridges in the cavity to support the $TM_{020}$ mode. Cavity 42 is also dimensioned to support this mode.

Output cavity 46 is configured substantially the same as output cavity 20 in the klystron embodiment of FIG. 1 so it is excited to the $TM_{020}$ mode. Hence, cavity 46 includes ridges 70 which define interaction gap 72. A hollow electron beam tunnel is thereby provided in resonator 46 between ridges 70 and gaps 72.

An output coupling structure coaxial with axis 60 and extending along the axis, in the center of output resonator 46, feeds the $TM_{020}$ mode electromagnetic field excited in the output resonator to load 74. The coaxial output coupling structure includes probe 76, in the center of resonator 46. Probe 76 is connected to inner conductor 78 of a coaxial line including exterior metal tube 80; conductor 78 extends along axis 60, while tube 80 is concentric with the axis and extends in the axial direction. Conductor 78 is connected to coupler 82 which supplies the RF energy transduced by probe 76 to load 74.

Input resonator 42 and output resonator 46 are respectively provided with ring-shaped dielectric RF vacuum windows 84 and 86, both of which are concentric with axis 60. Window 86 is located at the electric field minimum of output resonator 46; window 84 can be located in a similar position in resonator 42, although such placement is not particularly critical because of the relatively low electric fields to which the input resonator is subjected. By locating window 86 at the electric field minimum of output resonator 46, coupler 76 can be operated in air or a high pressure, insulating gas. Dielectric losses through window 86 are very low because it is positioned at the electric field minimum. In addition, the placement of window 86 at the electric field minimum of resonator 46, in a portion of the resonator removed from the output transmission lines, enables the resonator to be tolerant to high impedance mismatches between coupler 82 and load 74. This placement of window 86 eliminates the potential need for an RF circulator to handle the mismatch; this is highly advantageous because of the cost of such circulators.

While no windows are illustrated in FIG. 1, it is to be understood that windows similar to those illustrated in FIG. 3 can be employed in the klystron configuration of FIG. 1.

Figure 4:
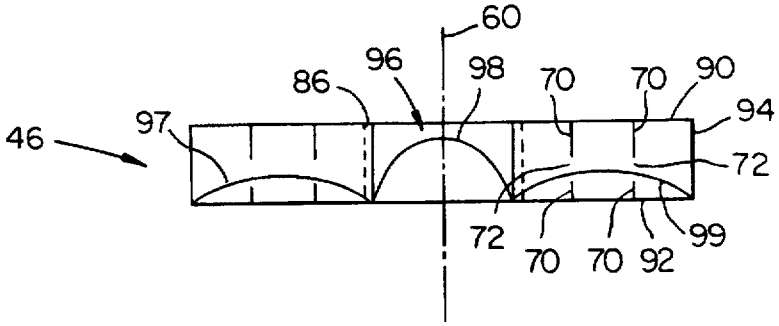
FIG. 4 is a schematic side cross-sectional view of a cavity resonator used in the embodiments of FIGS. 1 and 3, showing electric field variations in the $TM_{020}$ mode.
Figure 8:
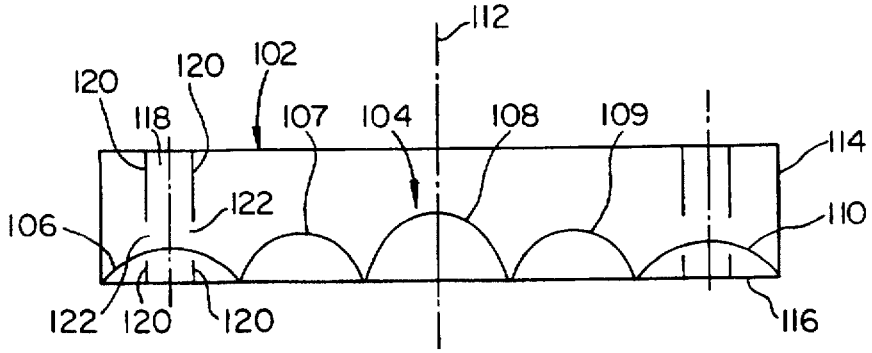
FIG. 8 is a schematic side cross-sectional view of resonant cavities illustrated in FIGS. 1 and 3, showing standing wave electric field variations in the $TM_{030}$ mode.
Figure 9:
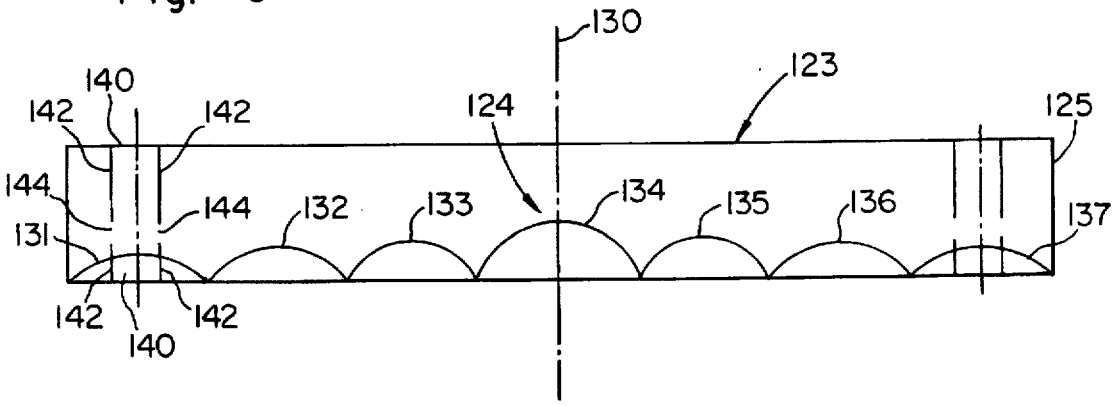
FIG. 9 is a schematic side cross-sectional view of resonators in the embodiments of FIGS. 1 and 3, showing electric field variations in the $TM_{040}$ mode.

The resonators of tube 40 can be dimensioned and arranged to be excited to any of modes $TM_{0x0}$, where x is an integer greater than 1; the cavity structures of any of FIGS. 4, 8 or 9 (where x=2, 3 and 4) can be employed.

Output cavity 46 is schematically illustrated in FIG. 4 as including top and bottom end faces 90 and 92 and ring-shaped side wall 94, as well as annular ridges 70, annular interaction gap 72 and ring-shaped window 86. Of course, end faces 90 and 92, side wall 84 and ridges 70 are all made of metal. The hollow electron beam tunnel is provided between ridges 70.

Wave 96 is superimposed on the resonant cavity structure schematically illustrated in FIG. 4. Wave 96 represents the magnitude of the axial electric field standing wave induced in the $TM_{020}$ mode resonant cavities of FIGS. 1 and 3. Wave 96 includes three segments 97, 98 and 99, each configured as one-half cycle of a wave that approximates a cosine wave. (Actual field variation is described by a Bessel function.) Wave segments 97 and 99 have equal amplitudes in the centers of the electron beam tunnel, while wave segment 98 has a peak value on center line 60. (A cavity excited to the $TM_{010}$ mode includes only wave segment 98, the nulls of which are on the cavity side wall.) Wave 96 has a zero magnitude on side wall 94, as well as a zero value approximately one-half way between the center of the electron beam tunnel and center line 60. Window 86 is located at the point in the resonator where wave segments 97, 98 and 99 intersect, i.e., where the electric field has a minimum value in resonator 46 at a point removed from side wall 94.

Because the center of the hollow electron beam tunnel is approximately coincident with the maximum magnitude of wave segments 97 and 99, and because probe 76 (in the embodiment of FIG. 3) is located where wave segment 98 has its maximum value, there is very strong coupling between the electron beam and output probe 76.

Figure 5:
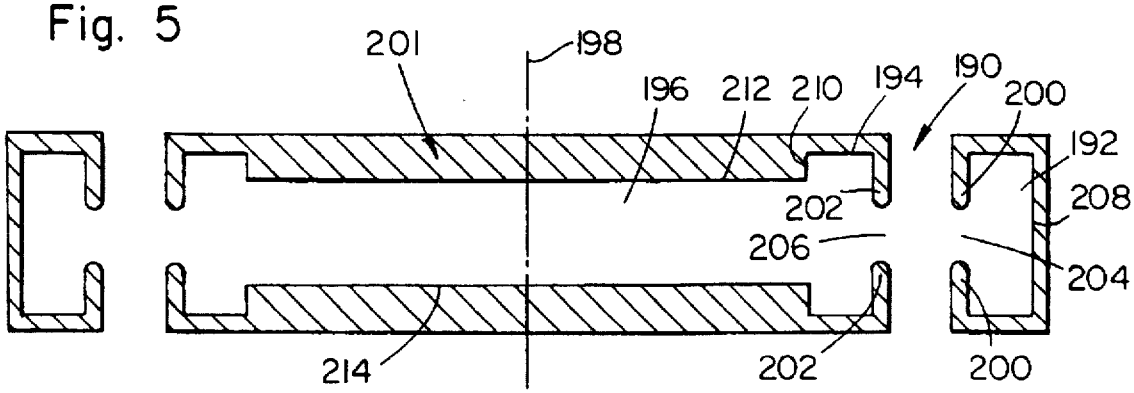
FIG. 5 is a detailed side cross-sectional view of a $TM_{020}$ coaxial output resonator suitable for the tubes of FIGS. 1 and 3 or of a $TM_{020}$ coaxial intermediate resonator for the tube of FIG. 1, in accordance with one embodiment of the invention.

Details of pill box cavity resonators 14, 17, 18 and 20 in the klystron embodiment of FIG. 1 and of output $TM_{020}$ pill box cavity resonator 46 in the embodiment of FIG. 3 are illustrated in FIG. 5 as including annular electron beam tunnel 190, exterior and interior axially extending cavity portions 192 and 194 and radially extending central cavity portion 196, all of which are in pill box-shaped metal block 201. The entire structure illustrated in FIG. 5 is concentric and symmetrical with center line 198 that is coincident with the longitudinal axes of the tubes illustrated in FIGS. 1 and 3. Ring-shaped ridges 200 and 202 extend axially between tunnel 190 and exterior and interior cavity portions 192 and 194 so annular interaction regions formed by gaps 204 and 206 are provided between the exterior and interior portions 192 and 194. Radially extending portion 196 has an axial extent somewhat less than the equal axial extents of portions 192 and 194.

Wave portions 97 and 99 (FIG. 4) are established between side walls 208 and 210 of exterior and interior portions 192 and 194. Hence, the axial electric fields have a zero magnitude at side wall 208 which defines the side wall of the pillbox resonator, as well as at side wall 210, which intersects radially extending walls 212 and 214 of radially extending waveguide portion 196. Wave segment 98 (FIG. 4) is established in radially extending portion 196.

Figure 6:
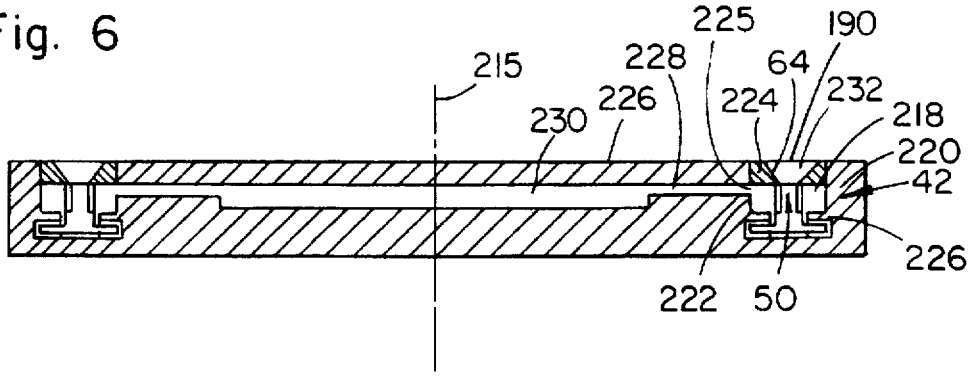
FIG. 6 is a detailed side cross-sectional view of a $TM_{020}$ coaxial input resonator suitable for the tube of FIG. 3, in accordance with one embodiment of the invention.

Details of $TM_{020}$ mode pill box input cavity resonator 42 in the embodiment of FIG. 3 are illustrated in FIG. 6 as having center line 215 that is coincident with the longitudinal axis of the tube illustrated in FIG. 3. Input resonator 42 includes pill-box-shaped metal block 226 having formed therein outer, ring-shaped cavity portion 218, including cathode 50 and grid 64. Outer cavity portion 218 includes axially extending circular side walls 220 and 222, spaced from each other by a distance somewhat greater than the difference between the inner and outer diameters of tunnel 190. Ring-shaped end face 224 of cavity portion 218 includes a central annular opening in which are mounted annular grid 64. Behind the grid is cathode structure 50. For this particular pair of resonators, the difference between the inner and outer diameters of each of cathode 50 and grid 64 is approximately one-third the difference between the inner and outer diameters of tunnel 190; the centers of cathode 50 and grid 64 of these structures coincide with the center of tunnel 190 and occur approximately at the peak value of wave portions 97 and 99, FIG. 4. (It is to be understood that other dimensional relations can exist than those specifically indicated.) To enable the electron beam emitted by cathode 50 and controlled by grid 64 to propagate from the grid cathode structure through electron beam tunnel 190, metal block 226 includes ring-shaped opening 232, having its center aligned with the common center of the grid and cathode, and having frusto-conical walls 234 (FIG. 7) in cross section.

Figure 7:
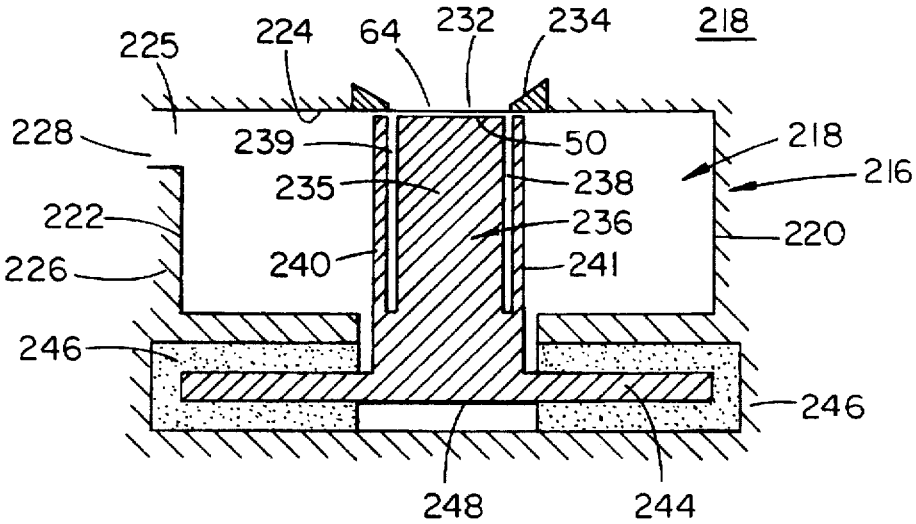
FIG. 7 is a detailed side cross-sectional view of a portion of the structure illustrated in FIG. 6, particularly showing a preferred configuration for the grid-cathode structure illustrated therein.

As shown in FIGS. 6 and 7, side wall 222 extends axially so it is spaced by relatively narrow gap 225 from end face 224. Neck 228 extends radially from gap 225 between side wall 222 and end face 224 toward center line 215. The interior end of neck 228 terminates in radially extending central portion 230 of block 226. Radially extending segment 230 has an axial extent greater than the axial extent of neck 228 but less than the axial extent of exterior cavity portion 218. Neck 228 functions as a relatively low impedance structure between radially extending portion 230 and exterior portion 218. The electric field null between the two peaks of the electric fields in the $TM_{020}$ mode, as indicated by the intersections of wave portions 97 and 98 and wave portions 98 and 99 (FIG. 4), exists approximately in the middle of neck 228.

Details of exterior cavity portion 218 are illustrated in FIG. 7, wherein cathode 50 is illustrated as being supported on central metal hollow stub 235 of axially extending metal ring 236. Ring 236 includes axially extending slots 238 and 239 and axially extending annular flanges 240 and 241, which assist in focusing the electron beam emitted by cathode 50 and form heat shields to minimize the transfer of heat from central portion 235 to the remainder of the tube. Ring 236 also includes hoop-like base 244 for support and heat dissipation purposes. The radially extending portion of base 244 is surrounded by ceramic blocks 246, each having a radially extending slot for accommodating the radially extending flanges of base 244. The exterior circular end wall of ceramic block 246 abuts the circular metal walls of block 216 in which resonator structure 42 is formed. Ceramic block 246 maximizes RF coupling from the cathode structure to metal block 216 and effectively functions as an RF choke to prevent the RF fields induced in cathode support structure 236 from reaching the lower face 248 of base 244. Ceramic block 246 allows d.c. biasing of cathode 50 with respect to grid 64 so electrons are emitted from cathode no more than one half of an RF cycle source.

For high frequencies, it is desirable to use high order modes for increased power handling capability. The radial variations of the magnitudes of the axial electric fields for the $TM_{030}$ and $TM_{040}$ modes in pill box resonant cavity resonators that can be used in alternate embodiments are respectively illustrated in FIGS. 8 and 9.

In the $TM_{030}$ mode of FIG. 8, the magnitude of the axial standing wave electric field variations are indicated in pill box resonator 102 by wave 104 including half cosine-like wave segments 106, 107, 108, 109, 110. Wave segments 106 and 110, next to the circular side wall 114 of resonator 102, have peak values somewhat less than the peak values of intermediate wave segments 107 and 109, while wave segment 108, on center line 112 of resonator 102, has the largest magnitude. An electric field null subsists on side wall 114, as indicated by the intersection of the left and right portions of wave segments 106 and 110 with side wall 114 and circular end face 116. The electric field has intermediate nulls, indicated by the intersections of adjacent wave segments 106, 107, 108, 109, 110 and bottom end face 116 of resonator 102. Electron beam tunnel 118 in resonator 102 is approximately at the peaks of the electric fields indicated by wave segments 106 and 110. Tunnel 118 is defined by metal ridges 120 that extend in the same direction as center line 112 and define gaps 122 between adjacent, facing edges of the tunnel; the gaps form interaction regions between the electron beam and the fields in the resonator.

The radial variations of the magnitude of the axial electric field are illustrated in pill box resonator 123, FIG. 9, for the $TM_{040}$ mode as standing wave 124, including half cosine-like wave segments 131, 132, 133, 134, 135, 136, 137. The maximum magnitude of the electric field associated with wave segment 134 at center line 130 of resonator 123 is greater than the magnitudes associated with the maxima of each of wave segments 131, 132, 133 and 135, 136, 137. Wave segments 131 and 137, adjacent side wall 125, have the lowest peak values, while the remaining wave segments have progressively larger values, as a function of radial position relative to center line 130.

Beam tunnel 140, defined by ridges 142 that extend parallel to axis 130, is located approximately at the peak of wave segments 131 and 137. Interaction region gaps 144 are defined by the space between adjacent, facing edges of ridges 142.

Figure 10:
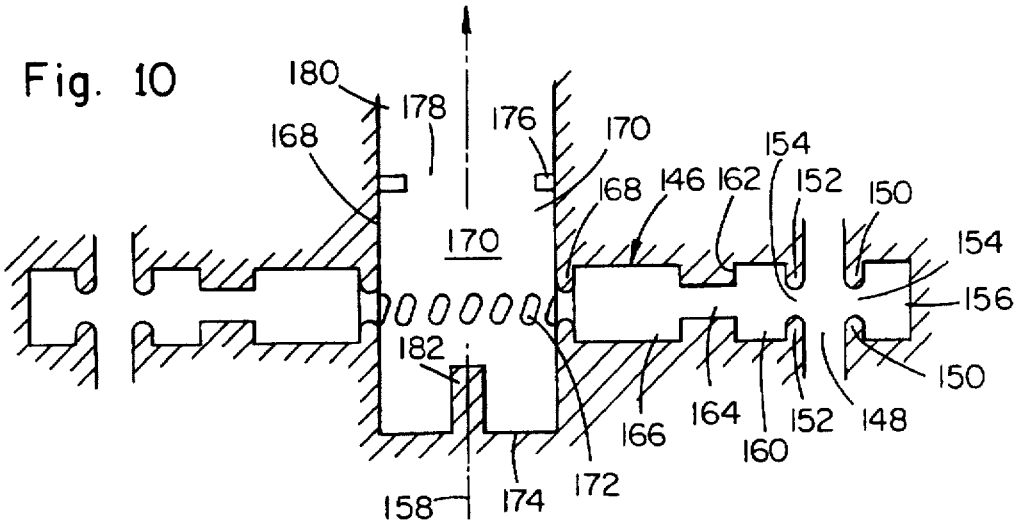
FIG. 10 is a side cross-sectional view of a modification of an output resonator excited to the $TM_{040}$ mode, in combination with a coupler and transition resonant cavity coupled to a wave guide operating in the $TE_{01}$ mode and located on the longitudinal axis of the tube.

The $TM_{040}$ mode pill box resonant cavity can be effectively employed to couple energy to a cylindrical wave guide operating in the $TE_{01}$ mode by way of a transitional resonator excited to the $TE_{011}$ mode, by the structure illustrated in FIG. 10, which can be used as an alternative to the $TE_{020}$ output cavities of FIGS. 1 or 3. The $TE_{01}$ cylindrical wave guide mode is particularly advantageous because it has low propagation losses (compared to a $TM_{02}$ mode). The only tangential magnetic field component on the waveguide cylindrical wall is an axial component that decreases with increasing frequency.

To these ends, $TM_{040}$ mode pill box output resonant cavity 146, illustrated in FIG. 10 as having center line 158, includes hollow electron beam tunnel 148 between ring-shaped metal ridges 150 and 152, having adjacent facing edges defining interaction region gaps 154. Resonator 146 includes annular exterior portion 156 and hollow interior portion 160 that respectively extend radially beyond and inside of tunnel 148. Portions 156 and 160 are separated from tunnel 148 by ridges 150 and 152. Interior portion 160 includes side wall 162 that extends parallel to tunnel 148 and center line 158, on a side of the interior portion remote from ridge 152. Side wall 162 ends at neck 164 that extends radially from interior portion 160 to center annular portion 166.

The end of center portion 166 closest to center line 158 ends at metal wall 168 of transitional resonator 170, configured to be excited to the $TE_{011}$ mode for the frequencies of the RF source modulating the electron beam in tunnel 148. Metal wall 168 includes peripheral slots 172 that are tilted with respect to axis 158 so that the axis of the slots is neither 0° nor 90° with respect to axis 158. Slots 172 extend into center portion 166, to provide coupling of the electromagnetic fields in resonator 146 to resonator 170. The number of slots 172 and the tilt angle thereof are determined by the desired degree of coupling from resonator 146 to resonator 170.

Resonator 146 is dimensioned and configured so wave portions 131 and 137 (FIG. 9) are respectively established in portions 156 and 160 thereof, so that the maximum values of the wave portions are approximately coincident with the center of beam tunnel 148. The null between wave portions 131 and 132 and between wave portions 136 and 137 occur in neck 164, while wave portions 132 and 136 occur in center portion 166. The diameter of $TE_{011}$ transitional resonator 170 is such that the three peaks of wave portions 133, 134 and 135 might occur therein. The three highest peaks in the electric fields in resonator 123 (FIG. 9) can occur in resonator 170 because of the coupling provided by slots 172 in wall 168.

Opposite circular end faces of cylindrical resonator 170 are established by metal end face 174 and by metal ring or ridge 176 that extends radially inward toward axis 158 from cylindrical wall 168. Coupling slot 178, formed between the facing interior edges of ridge 176, couples energy from resonator 170 to cylindrical wave guide 180, that operates in the $TE_{01}$ mode and which has its longitudinal axis coincident with axis 158.

Metal perturber spike 182 extends inwardly of cavity 170, along axis 158. Spike 182 is dimensioned to deform the electric field of the $TM_{020}$ mode (composed of wave portions 133, 134 and 135, FIG. 9), so the $TM_{020}$ mode does not become established in resonator 170 to such an extent that it compromises the purity of the $TE_{011}$ mode in the transitional resonator.

Figure 11:
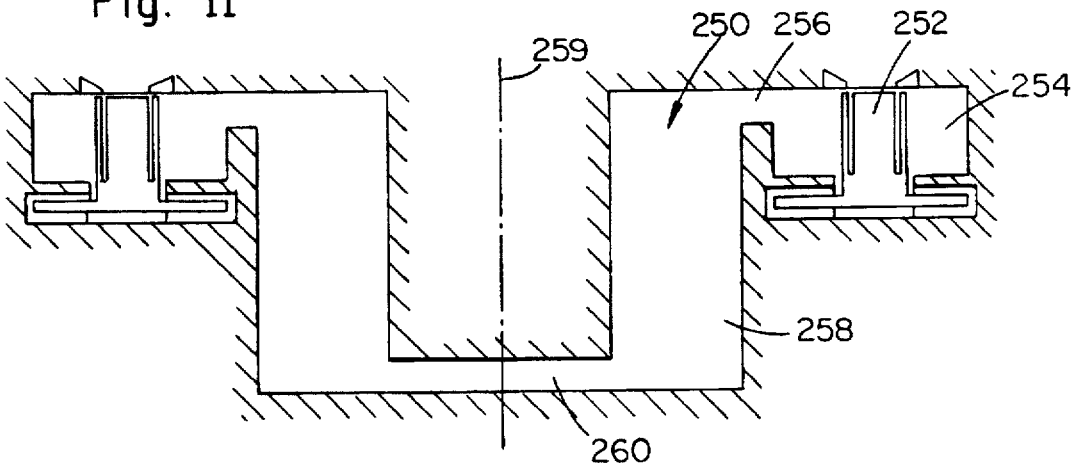
FIG. 11 is a detailed view of a modified $TM_{020}$ coaxial input resonator for the inductive output tube of FIG. 3, particularly adapted to be used for relatively low frequency input signals, e.g., less than 500 MHz.
Figure 12:
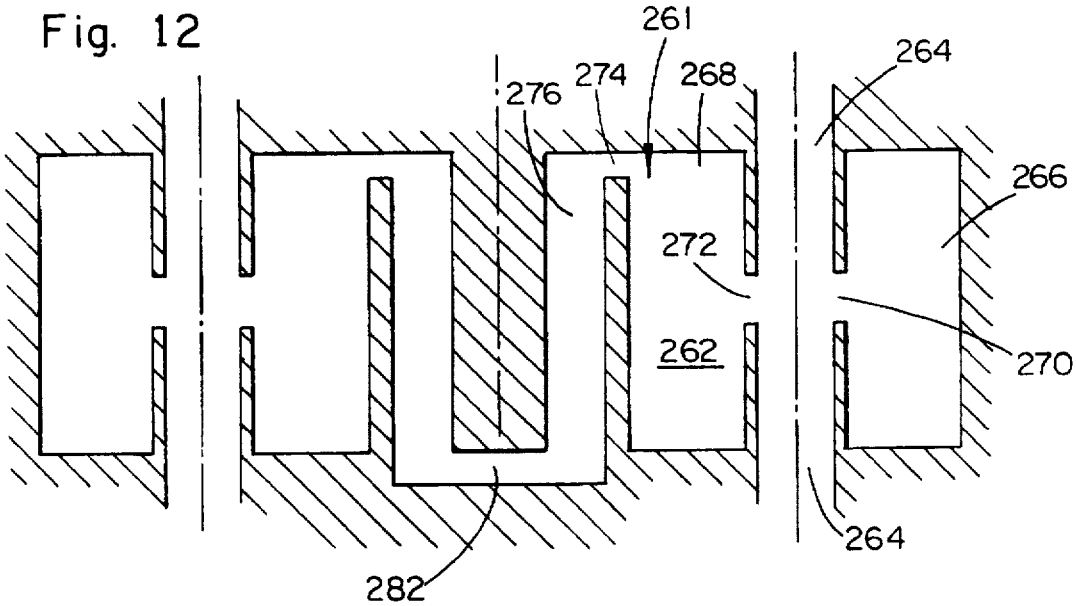
FIG. 12 is a detailed side cross-sectional view of a modified $TM_{020}$ input, intermediate or output resonator for the klystron of FIG. 1 and output resonator for the inductive output tube of FIG. 3, particularly adapted to be used for relatively low frequency input signals.

For applications in which the frequency of RF source 52 (FIG. 3) is less than 500 MHz, the output and input resonators of FIGS. 5 and 6 are respectively modified as illustrated in FIGS. 11 and 12. The radius of the resonators of FIGS. 11 and 12 and of other resonators typically handling the $TM_{0x0}$ modes (wherein x is an integer greater than 1) is inversely proportional to the frequency that the resonators handle and approximately proportional to the value of x. For frequencies of sources 24 and 52 less than 500 MHz, the diameters of the $TM_{020}$ mode resonators of FIGS. 5 and 6 are impractically large.

To overcome the aforementioned problem, the diameters of the $TM_{020}$ mode resonators illustrated in FIGS. 11 and 12 are reduced relative to those of FIGS. 6 and 5 by forming the inner part of each resonator as an axially extending quarter wavelength long coaxial resonator and by radially compressing and axially extending the exterior region of the resonator. In consequence, the outer diameters of the resonators illustrated in FIGS. 11 and 12 are one half or less of the outer diameters of the resonators illustrated in FIGS. 6 and 5 for the $TM_{020}$ mode for the same frequency ranges.

As illustrated in FIG. 11, modified input resonator 250 for the inductive output tube of FIG. 3 includes cathode grid structure 252 similar to the cathode grid structure illustrated in FIG. 7. Cathode grid structure 252 is mounted in exterior wave guide portion 254 that is also the same as the exterior portion of the resonator illustrated in FIG. 7. Exterior resonator portion 254 is connected by radially extending short neck 256 to axially extending quarter wave length coaxial resonator 258, i.e., resonator 258 has a length in the direction of center line 259 of the resonator that is approximately one-quarter of a wave length of the center frequency of the signal being amplified by the tube including the resonator; in actuality resonator 258 is slightly shorter than one-quarter of a wavelength due to the capacitance in the central portion 260. The end of quarter wave length coaxial resonator 258 remote from neck 256 is connected to radially extending central portion 260 of resonator 250.

Figure 13:
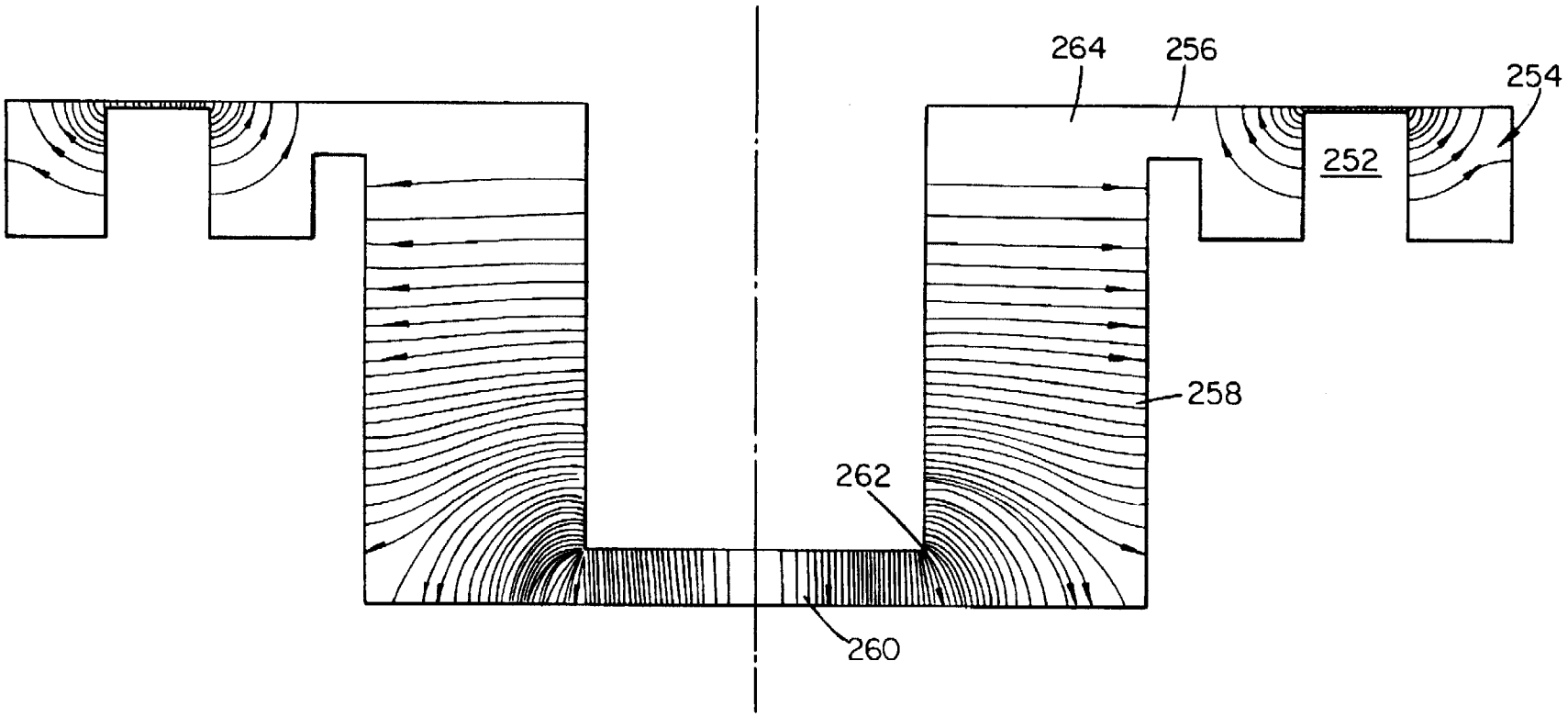
FIG. 13 is a schematic side cross-sectional view of the electric field distribution in the input resonator illustrated in FIG. 11.

The electric field distribution of the resonator illustrated in FIG. 11 is shown in FIG. 13, wherein the intensity of the electric field is indicated by the number of field lines and the direction of the field at one time instant is indicated by the pointing directions of the arrows. From FIG. 13, the maximum electric field distribution, corresponding with the axial peak in the resonator of FIG. 4, occurs in region 262, at the junction of the lower end of quarter wave length coaxial resonator 258 and radially extending interior portion 260. The electric field null corresponding with the null between wave portions 98 and 99 (FIG. 4) occurs in region 264, at the intersection between the upper end of quarter wave length coaxial resonator 258 and neck 256. The peak of the electric field distribution corresponding with the peak of wave portion 99 (FIG. 4) occurs in the center of cathode structure 252. Hence, the electric field distribution of the structure illustrated in FIG. 11 basically corresponds with the $TM_{020}$ mode of the input resonator of FIG. 4.

Reference is now made to FIG. 12 of the drawing, a cross-sectional view of a resonator 261 particularly adapted for use for frequencies under 500 MHz for resonators 14, 17, 18 and 20 in the klystron of FIG. 1 and as output resonator 46 in the inductive output tube of FIG. 3. Resonator portion 262 includes beam tunnel 264, exterior portion 266 and interior portion 268, as well as gaps 270 and 272, all of which correspond with tunnel 190, exterior portion 192, interior portion 194, and gaps 204 and 206 of the resonator illustrated in FIG. 5.

Interior portion 268 of external resonator 262 is connected by radially extending short neck 274 to axially extending quarter wave length coaxial resonator 276. The end of quarter wave length coaxial resonator 276 remote from neck 274 is connected to radially extending central portion 282 of resonator 261.

Figure 14:
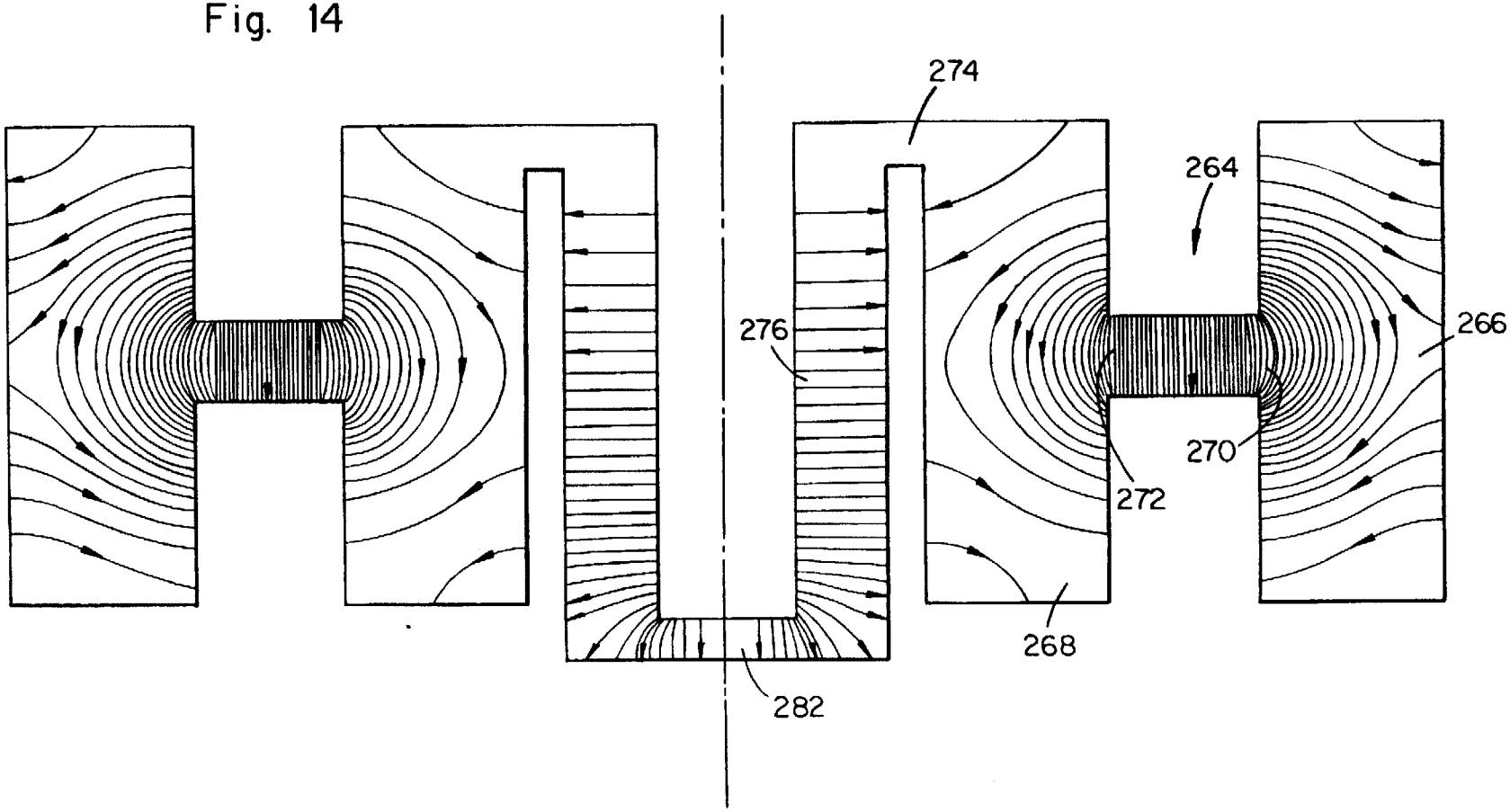
FIG. 14 is a schematic side cross-sectional view of the electric field distribution in the resonator of FIG. 12.

The electric field distribution of the resonator illustrated in FIG. 12 is illustrated in FIG. 14. There is an electric field maximum (corresponding to the maximum in wave portions 97 and 99, FIG. 4) in gaps 270 and 272 where electron beam tunnel 264 is connected to exterior and interior resonator portions 266 and 268. An electric field null (corresponding to the null at the intersections between wave portions 97 and 98 and wave portions 98 and 99) occurs in neck 274. A second maximum, corresponding with the maximum of wave portion 98, occurs at the junction of quarter wave length coaxial resonator 276 and radially extending resonator portion 282. Hence, the electric field distribution of the structure illustrated in FIG. 12 basically corresponds with the $TM_{020}$ mode of the resonator of FIG. 4.

Figure 15:
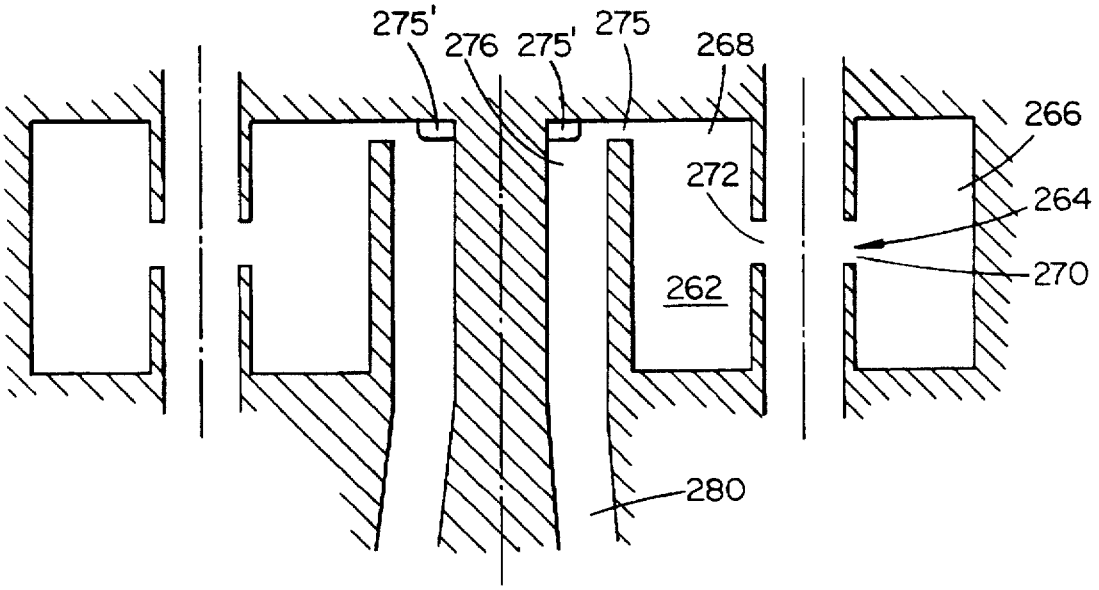
FIG. 15 is a schematic side cross-sectional view of the resonator of FIG. 12 connected to a coaxial output line.

As mentioned previously, a resonator of the type illustrated in FIG. 12 may be used as output resonator 20 in the klystron of FIG. 1 and output resonator 46 in the inductive output tube of FIG. 3. A preferred configuration for such an output resonator is illustrated in FIG. 15, where parts corresponding with the parts already described in FIGS. 12 and 14 have the same reference numerals. The end of the quarter wave length coaxial line 276 at the radially extending portion 282 in FIG. 12 is connected to coaxial output line 280. The diameter of the coaxial line is tapered to provide sufficient space between the inner and outer radii to accommodate an RF dielectric window (not shown) with the required power handling capability.

Magnetic field coupling between output resonator 262 and coaxial line 276 is obtained by several radially extending coupling slots 275, as indicated in the cross-sectional view and as illustrated by far end-view 275'. The number and angular extension of the slots are selected to obtain the required external Q-factor of resonator 262.

Figure 16:
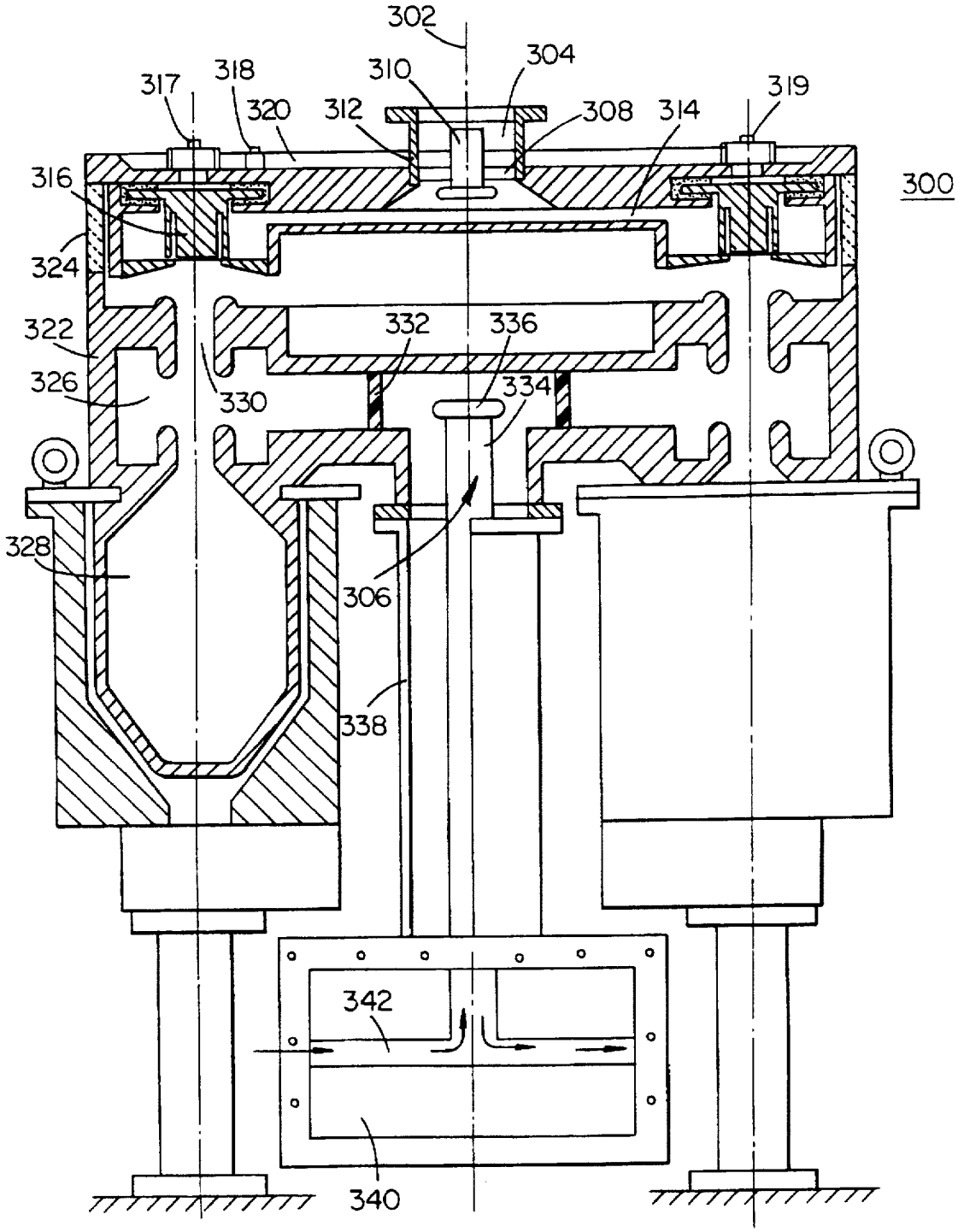
FIG. 16 is a detailed, cross-sectional view of a tube of the type illustrated in FIG. 3.

Details of an inductive output tube of the type generally shown in FIG. 3 are illustrated in FIG. 16 wherein inductive output tube 300, having longitudinal, center axis 302 includes coaxial input coupler 304 and coaxial output coupler 306. Input coupler 304 includes interior axially extending metal rod 310 and exterior coaxial metal tube 312, both of which extend in the direction of axis 302. Coupler 304 also includes input window 308, disposed at right angles to axis 302 and intersecting line 310 and tube 312. Coupler 304 transduces the coaxial mode between line 310 and tube 312 into a rectangular $TM_{020}$ mode that is excited in input resonator 314, including assembly 316 containing a ring-shaped cathode and heater (not shown); assembly 316 is maintained at a negative DC voltage with respect to the remainder of resonator 314. Input resonator 314 is at high negative DC potential with respect to the ground. Heater connector 318 of cathode assembly 316 is mounted in metal end face 320. The cathode and one heater leg are connected internally to end face 320, and the external connection is made at connector 318. Negative bias between the grid and cathode is provided through connector 319. The entire tube is encased in a vacuum housing including metal end face 320, and metal side wall 322, which is spaced and electrically insulated from end face 320 by ceramic ring 324.

Output resonator 326, collector 328 and beam tunnel 330, all integrally formed in side wall 322, are maintained at approximately ground potential. RF vacuum window 332 is provided in output resonator 326 at the electric field null in the $TM_{020}$ mode formed in the output resonator.

Coaxial output coupler 306 includes interior metal rod 334 that extends axially along axis 302. Rod 334, surrounded by axially extending metal tube 338, ends in dish shaped probe 336, surrounded by ring-shaped RF vacuum window 332. The structure in tube 338 is at atmospheric pressure, by virtue of the vacuum established across window 332.

The coaxial line comprising rod 334 and tube 338 terminates in coaxial to rectangular wave guide coupler 340. Water or some other suitable cooling medium is supplied to coupler 340 and to the interior of tube 338 from a suitable source (not shown) via conduit 342 in the coupler.

Figure 17:
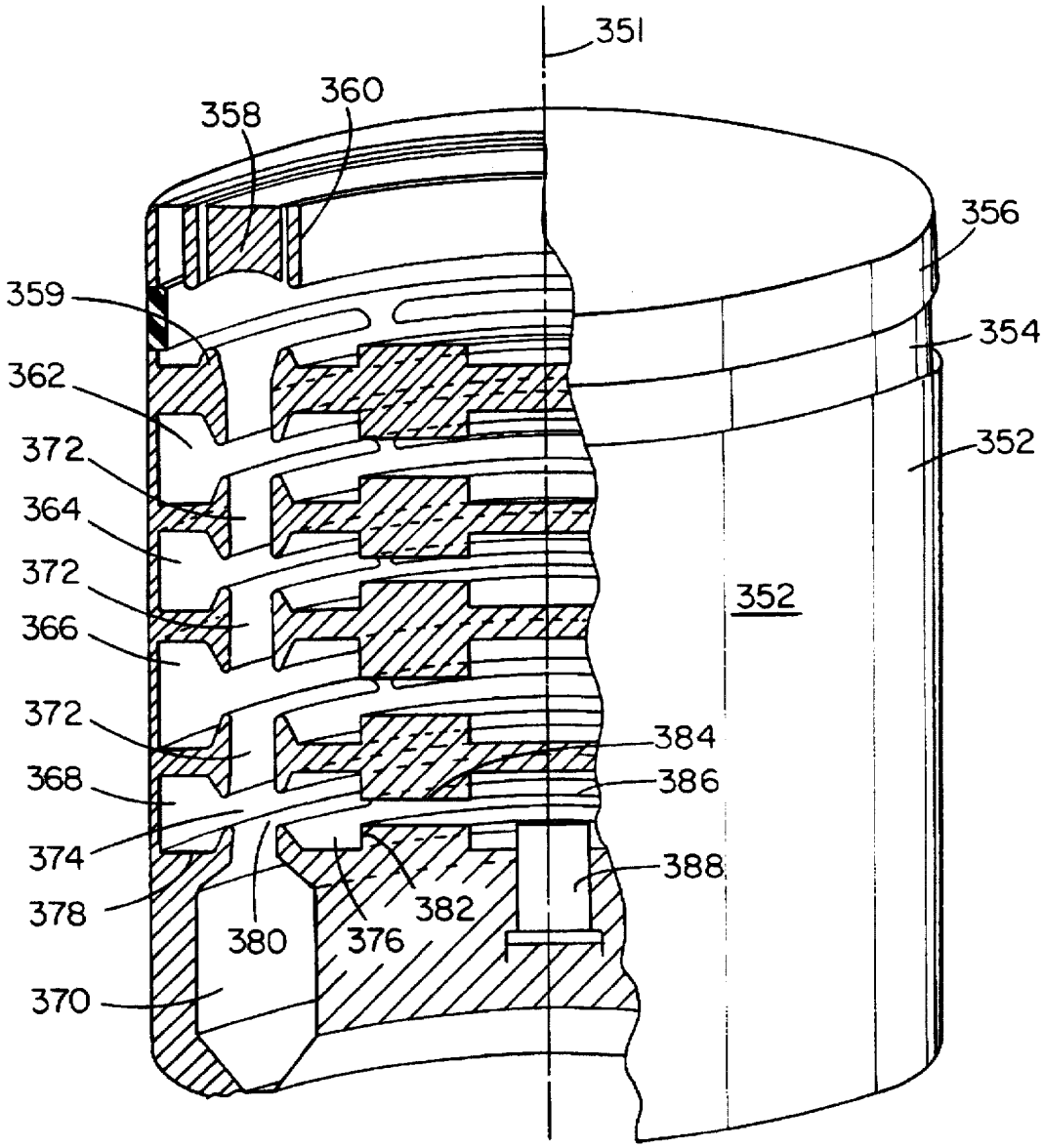
FIG. 17 is a perspective view of a klystron, of the type schematically illustrated in FIG. 1, having resonators excited to the $TM_{020}$ mode.

A perspective view of a klystron amplifier, of the type illustrated in FIG. 1, is illustrated in FIG. 17. The klystron structure illustrated in FIG. 17 has central longitudinal axis 351 and includes a cylindrical vacuum housing 350, including metal sleeve 352, insulator ring 354 and metal end cap 356. A conventional means (not shown) for magnetically focusing the electron beam provided. Except for the RF connector to the input resonator, the entire structure of FIG. 17 is symmetrical relative to axis 351. Cathode assembly 358 and heat shield 360, which also functions as a focusing electrode for electrons emitted by the cathode, are mounted in end cap 356. The structure in end cap 356 is maintained at a high negative DC voltage, while the structure in sleeve 352, anode 359 and focus electrode 360 are generally maintained at approximately ground voltage.

Downstream of the hollow, annular electron beam derived from cathode assembly 358 are input resonator 362, intermediate resonators 364 and 366 and output resonator 368, all excited to the $TM_{020}$ mode. Input resonator 362 can be excited by a coaxial coupler, as illustrated in FIG. 1. Output resonator 368 is coupled to axially extending cylindrical wave guide 388, which extends along axis 351 of housing 350. Downstream of output-resonator 368 is collector 370, that is cooled in the usual manner. Between each of resonators 362, 364, 366 and 368 are drift regions 372.

Each of resonators 362, 364, 366 and 368 includes a gap that interacts with the electron beam that subsists between cathode assembly 358 and collector 370. Each of resonators 362, 364, 366 and 368 includes hollow interior and exterior portions 377 and 378 on each side of beam tunnel 374 and is coupled with the beam tunnel by way of gap 380. Side wall 382 on portion 376 remote from gap 380 opens into radially extending neck 384, which in turn opens into central radially extending portion 382 of each resonator. Neck 384 provides a higher interaction impedance than would be provided if it had the same axial extent as the outer part of the resonator. The higher interaction impedance is a result of less energy being stored in the resonators. It is to be understood that, if desirable, the axial extent of interior portion 386 could be the same as the axial extent of neck 384.

While there have been described and illustrated several specific embodiments of the invention, it will be clear that variations in the details of the embodiments specifically illustrated and described may be made without departing from the true spirit and scope of the invention as defined in the appended claims. For example, alternatives to the illustrated support for inner resonator core 38 of FIG. 2 can be arranged so there are fewer than four beam tunnel segments 32; for example, three beam tunnel segments can be provided. To avoid segmenting the beam tunnel, the inner core of the resonators in the klystron can be supported by three or more hollow metal rods extending parallel to the axis of the tube; such rods would be radially located at the field minimum in the $TM_{020}$ mode resonator (or one of the other field minima in the other $TM_{0x0}$ modes). Such rods would be connected to and supported by the tube body at the collector end of the RF circuit and include water-channels for cooling the RF circuit inner core. The rods may be used and placed adjacent internal ceramic window 86, FIG. 3.

We claim:

1. An electron tube for handling a signal having a frequency in a predetermined frequency band comprising: means for deriving a substantially hollow linear electron beam, means for collecting the substantially hollow linear electron beam, a predetermined beam tunnel, the beam tunnel being arranged between the means for deriving and the means for collecting so that the beam traverses the tunnel, and resonant cavity means having an interaction region coupled with the beam tunnel for varying the beam in the beam tunnel as a function of the signal, the resonant cavity means being disposed between the deriving and collecting means and configured so electromagnetic fields therein associated with the signal are in the $TM_{0x0}$ mode for frequencies in said predetermined frequency band, where x is an integer greater than 1, the resonant cavity means having a central axis and the electromagnetic fields associated with the signal include an electric field associated with the signal for the $TM_{0x0}$ mode, said $TM_{0x0}$ mode electric field associated with the signal having a maximum value substantially at the central axis and a peak value at a location substantially displaced from the central axis, the resonant cavity means being arranged so the electron beam interacts therein with the peak value of the $TM_{0x0}$ mode electric field that is substantially displaced from the central axis.

2. The electron tube of claim 1, wherein the resonant cavity means includes an input resonator for modulating the beam in response to the signal and the means for deriving includes a cathode and a grid disposed in the input resonator, the grid being coupled to a source of the signal for controlling the density of current in the beam in response to the signal.

3. The electron tube of claim 2, wherein the input resonator comprises a cavity including the grid and being configured so electromagnetic fields therein associated with the signal are in the $TM_{0x0}$ mode for frequencies in said predetermined frequency band.

4. The electron tube of claim 1, wherein the cavity means includes an output cavity responsive to the electron beam as modulated by the signal and configured so electromagnetic fields therein associated with the signal are in the $TM_{0x0}$ mode for frequencies in said predetermined frequency band.

5. The electron tube of claim 1, wherein the cavity means includes an input cavity coupled with a source of the signal for modulating the beam and an output cavity responsive to the electron beam as modulated by the signal, both said input and output cavities being configured so electromagnetic fields therein associated with the signal are in the $TM_{0x0}$ mode for frequencies in said predetermined frequency band.

6. The electron tube of claim 5, wherein the cavity means includes at least one intermediate cavity disposed between the input and output cavities, the at least one intermediate cavity being configured so electromagnetic fields therein associated with the signal are in the $TM_{0x0}$ mode for frequencies in said predetermined frequency band and said electromagnetic fields have a value whose magnitude is between magnitude values associated with electromagnetic fields in the input and output cavities.

7. The electron tube of claim 1, wherein the linear electron beam extends longitudinally along the direction of a longitudinal axis of the beam tunnel and the cavity means includes an output cavity coupled with a source of the signal for modulating the beam extending radially inward from the interaction region and the beam tunnel, the radial direction being at right angles to the longitudinal axis, the output cavity being configured so electromagnetic fields therein associated with the signal are in the $TM_{0x0}$ mode for frequencies in said predetermined frequency band, an output structure coupled with the output cavity, the output structure extending longitudinally along the same direction as the beam tunnel longitudinal axis and being located in the hollow portion of the beam.

8. The electron tube of claim 7, wherein the output structure is configured so electromagnetic fields therein associated with the signal are in a mode which is different from the mode of the electromagnetic field in the output cavity for frequencies in said predetermined frequency band, the output structure including means for suppressing the mode of the electromagnetic field in the output cavity for frequencies in the band.

9. The electron tube of claim 8, wherein the output structure includes another cavity located inside of the output cavity, a wall between the another cavity and the output cavity, the another cavity being arranged so a $TE_{011}$ mode is present therein for frequencies in said predetermined frequency band, and means for coupling the $TM_{0x0}$ electromagnetic field mode in the output cavity to the another cavity.

10. The electron tube of claim 9, wherein the coupling means includes slots in the wall, the slots being at an angle between but not including 0° and 90° relative to a plane extending radially from the longitudinal axis.

11. The electron tube of claim 7, wherein the beam tunnel is at a vacuum pressure and the output structure is at a different pressure from the beam tunnel vacuum pressure, further including an RF dielectric vacuum window in the output cavity approximately where the electromagnetic field associated with the signal in the output cavity has a minimum electric field, the RF window being at a position between a region having about the same vacuum pressure as the beam tunnel and a zone having a different pressure about equal to the pressure where the output structure is located.

12. The electron tube of claim 1, wherein the linear electron beam extends longitudinally along the direction of a longitudinal axis of the beam tunnel and the cavity means includes an input cavity coupled with a source of the signal for modulating the beam and extending radially inward from the interaction region and the beam tunnel, the radial direction being at right angles to the longitudinal axis, the input cavity being configured so electromagnetic fields therein associated with the signal are in the $TM_{0x0}$ mode for frequencies in said predetermined frequency band, an input structure coupled with the input cavity, the input structure extending longitudinally in the same general direction as the beam tunnel longitudinal axis and being located in the hollow portion of the beam.

13. The electron tube of claim 1, where x=2.

14. The electron tube of claim 1, where x=3.

15. The electron tube of claim 1, where x=4.

16. The electron tube of claim 1, wherein the cavity means includes an input cavity coupled with a source of the signal for modulating the beam and configured so electromagnetic fields therein associated with the signal are in the $TM_{0x0}$ mode for frequencies in said predetermined frequency band, the input cavity including a portion extending radially outside the beam tunnel, the radial direction being substantially at right angles to a longitudinal axis of the beam tunnel, and means for coupling the signal to the cavity portion outside the beam tunnel.

17. The electron tube of claim 1, wherein the resonant cavity means includes plural resonators for deriving electromagnetic fields in response to the signal and excited to the $TM_{020}$ mode of the signal, each of the resonators including an axially extending coaxial resonator extending along the direction of the central longitudinal axis and having a length in the direction of the central longitudinal axis equal approximately to a quarter wavelength of a frequency in said predetermined frequency band.

18. The electron tube of claim 1 wherein the resonant cavity means includes input, intermediate and output cavities arranged so that the electron beam in the intermediate and output cavities interacts with the peak value of the $TM_{0x0}$ mode electric field that is substantially displaced from the central axis.

19. A resonant cavity comprising a substantially annular hollow electron beam tunnel, a resonant cavity structure having an interaction region coupled with the tunnel, the structure having an outer portion surrounding the tunnel and an inner portion surrounded by the tunnel, the resonant cavity structure being configured in a $TM_{0x0}$ mode for oscillations of an electron beam traversing the tunnel, where x is an integer greater than 1, the cavity having a central axis and a maximum electric field for the $TM_{0x0}$ mode of the oscillations of the electron beam, the maximum electric field being substantially at the central axis, the $TM_{0x0}$ mode having: a peak electric field for the oscillations of the electron beam at a location substantially displaced from the central axis, the peak electric field for the $TM_{0x0}$ mode being established in the tunnel, the tunnel and resonant cavity structure being arranged so the electron beam interacts with the peak electric field for the $TM_{0x0}$ mode in the tunnel.

20. The resonant cavity of claim 19, where x=3.

21. The resonant cavity of claim 19, where x=4.

22. The resonant cavity of claim 19 further including an RF vacuum window located away from metal walls of the cavity at a location where electric fields associated with a signal modulating an electron beam in the $TM_{0x0}$ mode and traversing the tunnel in the cavity have a magnitude close to zero.

23. The resonant cavity of claim 19, wherein the cavity is excited to the $TM_{020}$ mode and including an axially extending coaxial resonator extending along the direction of the central longitudinal axis and having a length in the direction of the central longitudinal axis equal approximately to a quarter wavelength of a frequency in said predetermined frequency band.

24. The resonant cavity of claim 19, where x=2.

25. A resonant cavity comprising a substantially annular hollow electron beam tunnel, a resonant cavity structure having an interaction region coupled with the tunnel, the structure having an outer portion surrounding the tunnel and an inner portion surrounded by the tunnel, the resonant cavity structure being configured so there is a location therein located away from metal walls of the cavity where there are electric fields having approximately a zero magnitude, the electric fields being associated with oscillations of an electron beam traversing the tunnel, the tunnel and resonant cavity structure being arranged so an oscillating electron beam in the tunnel traverses a portion of the tunnel radially displaced from a central axis of the cavity structure, electric fields of electromagnetic waves in the resonant cavity structure associated with the oscillations of the electron beam being of (a) maximum amplitude at the central axis and (b) at a peak amplitude at the tunnel.

26. The resonant cavity of claim 25, further including a dielectric vacuum window at the location.

27. An electron tube for handling an RF signal having a predetermined frequency band, the tube having a longitudinal axis and comprising an input coaxial feed responsive to the signal and concentric with the axis; a coaxial output feed concentric with the axis; said feeds extending in the direction of the axis and being centrally located relative to the axis; a cathode structure concentric with the axis for emitting an electron beam; an electron beam tunnel concentric with the axis and arranged relative to the cathode structure so that the emitted beam traverses the electron beam tunnel, an input resonant cavity structure: (a) including a first portion of the beam tunnel arranged so the beam propagates through the input resonant cavity structure via the first portion of the beam tunnel therein, (b) concentric with the axis and (c) coupled with the input coaxial feed via a region that extends radially from the axis so that the input resonant cavity structure is excited by the input signal to modulate the beam; an output resonant cavity structure: (a) including a second portion of the beam tunnel arranged so the beam propagates through the output resonant cavity structure via the second portion of the beam tunnel therein, (b) concentric with the axis and (c) coupled with the output coaxial feed via a region that extends radially toward the axis so that the output resonant cavity structure is excited by the modulated beam to drive the output coaxial feed, the input and output resonant cavity structures being excited in a $TM_{0x0}$ mode for frequencies in said predetermined frequency band, where x is an integer greater than 1.

28. The electron tube of claim 27, wherein the electron beam is substantially hollow and the electron beam tunnel has a ring-like shape with an inner diameter greater than outer diameters of the input and output coaxial feeds, said diameters being centered on the tube longitudinal axis.

29. The electron tube of claim 28 wherein the input and output resonators are both excited in the $TM_{020}$ mode, each of the resonators including an axially extending coaxial resonator having an axial length equal approximately to a quarter wavelength of a frequency in said predetermined frequency band.

30. The electron tube of claim 28, wherein the output resonant cavity structure is configured so there is, in a portion of the region thereof that extends radially toward the axis, an electric field associated with the signal has a magnitude that is approximately zero, said portion being displaced from the metal walls of the output cavity, an RF vacuum dielectric window at said portion of the region.

31. The electron tube of claim 27, wherein the output resonant cavity structure includes an RF vacuum window in a region that extends radially toward the axis, the window being at a location located away from metal walls of the output resonant cavity structure where an electric field associated with the signal has a magnitude of approximately zero.

32. The electron tube of claim 27, wherein the output resonant cavity structure is configured so there is, in a portion of the region that extends radially toward the axis, an electric field associated with the signal having a magnitude that is approximately zero; said portion being displaced from the metal walls of the output cavity, an RF vacuum dielectric window at said portion of the region.

33. An electron tube for handling an RF signal having a predetermined frequency range, the tube having a longitudinal axis and comprising an input coaxial feed responsive to the signal and concentric with the axis; a coaxial output feed concentric with the axis; said feeds extending in the direction of the axis and being centrally located relative to the axis; a cathode structure concentric with the axis for emitting an electron beam; an electron beam tunnel concentric with the axis and arranged relative to the cathode structure so the emitted beam traverses the electron beam tunnel, an input resonant cavity structure: (a) including a first portion of the beam tunnel arranged so the beam propagates through the input resonant cavity structure via the first portion of the beam tunnel therein, (b) concentric with the axis and (c) coupled with the input coaxial feed via a region that extends radially from the axis so the input resonant cavity structure is excited by the input signal to modulate the beam; an output resonant cavity structure: (a) including a second portion of the beam tunnel arranged so the beam propagates through the output resonant cavity structure via the second portion of the beam tunnel therein, (b) concentric with the axis and (c) coupled with the output coaxial feed via a region that extends radially toward the axis so the output resonant cavity structure is excited by the modulated beam to drive the output coaxial feed, another resonant cavity structure extending in the direction of the axis and being centrally located relative to the axis for coupling energy from the output resonant cavity structure to the output feed, the output and another resonant cavity structures being configured so they operate in different modes for frequencies in said predetermined frequency band, and means for coupling energy from the output to the another resonant cavity structures.

34. An electron tube for handling an RF signal having a predetermined frequency range, the tube having a longitudinal axis and comprising an input coaxial feed responsive to the signal and concentric with the axis; a coaxial output feed concentric with the axis; said feeds extending in the direction of the axis and being centrally located relative to the axis; a cathode structure concentric with the axis for emitting an electron beam; an electron beam tunnel concentric with the axis and arranged relative to the cathode structure so the emitted beam traverses the electron beam tunnel, an input resonant cavity structure: (a) including a first portion of the beam tunnel arranged so the beam propagates through the input resonant cavity structure via the first portion of the beam tunnel therein, (b) concentric with the axis and (c) coupled with the input coaxial feed via a region that extends radially from the axis so the input resonant cavity structure is excited by the input signal to modulate the beam; an output resonant cavity structure: (a)

including a second portion of the beam tunnel arranged so the beam propagates through the output resonant cavity structure via the second portion of the beam tunnel therein, (b) concentric with the axis and (c) coupled with the output coaxial feed via a region that extends radially toward the axis so the output resonant cavity structure is excited by the modulated beam to drive the output coaxial feed, the coupling means including slots in a metal wall between the output and another resonant cavity structures, the metal wall being concentric with and extending in the direction of the axis, the slots being in a tilted orientation relative to the axis so the slots are at an angle between but not including 0° and 90° relative to a plane at right angles to the tube longitudinal axis.

35. The electron tube of claim 34, wherein the output and another resonant cavities are respectively configured to operate in the $TM_{0x0}$ and $TE_{011}$ modes.

36. An electron tube for handling a signal having a frequency in a predetermined frequency band comprising: means for deriving a substantially hollow linear electron beam, means for collecting the substantially hollow linear electron beam, a predetermined beam tunnel, the beam tunnel being arranged between the means for deriving and the means for collecting so the beam traverses the tunnel, an input resonant cavity responsive to the signal coupled with the tunnel for modulating the electron beam traversing the tunnel in response to the signal so the beam in the tunnel is modulated, an output resonant cavity coupled with the tunnel to be responsive to the modulated beam, both said resonant cavities being configured so electromagnetic fields therein associated with the signal are in the $TM_{0x0}$ mode for frequencies in said predetermined frequency band, where x is an integer greater than one.

37. The electron tube of claim 36 further including at least one intermediate resonant cavity configured so electromagnetic fields therein associated with the signal are in the $TM_{0x0}$ mode and disposed between the input and output resonant cavities, the tunnel being coupled with each said intermediate cavity.

38. The electron tube of claim 37 wherein the tunnel extends through at least a part of each of said resonant cavities, the tunnel surrounding an inner portion of each of said resonant cavities and being surrounded by an outer portion of each of said resonant cavities.

* * * * *